US009086649B2

(12) United States Patent
Hosoda

(10) Patent No.: US 9,086,649 B2
(45) Date of Patent: Jul. 21, 2015

(54) IMAGE FORMING APPARATUS, CONTROL METHOD, AND STORAGE MEDIUM

(71) Applicant: CANON KABUSHIKI KAISHA, Tokyo (JP)

(72) Inventor: Yuichi Hosoda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/473,692

(22) Filed: Aug. 29, 2014

(65) Prior Publication Data

US 2015/0063842 A1 Mar. 5, 2015

(30) Foreign Application Priority Data

Aug. 30, 2013 (JP) ..... 2013-179999

(51) Int. Cl.
*G03G 15/08* (2006.01)

(52) U.S. Cl.
CPC ..... *G03G 15/0831* (2013.01)

(58) Field of Classification Search
CPC ..... G03G 15/0831
See application file for complete search history.

(56) References Cited

U.S. PATENT DOCUMENTS

| | | | | |
|---|---|---|---|---|
| 6,343,193 | B1 * | 1/2002 | Matsumoto et al. | 399/27 |
| 2010/0046966 | A1 * | 2/2010 | Ito | 399/27 |
| 2012/0294632 | A1 * | 11/2012 | Nishikawa | 399/27 |

FOREIGN PATENT DOCUMENTS

JP 2006-343621 A 12/2006

* cited by examiner

*Primary Examiner* — Sandra Brase
(74) *Attorney, Agent, or Firm* — Canon U.S.A. Inc., IP Division

(57) ABSTRACT

An image forming apparatus is provided in which, in a case where a calculated value is less than a predetermined value (for example, "low" level, or "out" level), and information indicating that a remaining toner amount is less than the predetermined value has not been acquired from a toner container, the predetermined value or a value a predetermined amount greater than the predetermined value is set as an initial value of the remaining toner amount.

14 Claims, 11 Drawing Sheets

FIG.11

| | NO TONER LOW HISTORY EXISTS | | TONER LOW HISTORY EXISTS | |
|---|---|---|---|---|
| | NO TONER OUT HISTORY EXISTS | TONER OUT HISTORY EXISTS | NO TONER OUT HISTORY EXISTS | TONER OUT HISTORY EXISTS |
| VALUE CALCULATED FROM PAGE COUNT: "LOW" OR MORE | NO CORRECTION | NO CORRECTION (FAULT) | CORRECTED TO "LOW" | NO CORRECTION |
| VALUE CALCULATED FROM PAGE COUNT: "OUT" OR MORE, AND LESS THAN "LOW" | CORRECTED TO "LOW"+1 | | NO CORRECTION | CORRECTED TO "OUT" |
| VALUE CALCULATED FROM PAGE COUNT: LESS THAN "OUT" (0 % OR MORE) | CORRECTED TO "LOW"+1 | | CORRECTED TO "OUT"+1 | NO CORRECTION |

IMAGE FORMING APPARATUS, CONTROL METHOD, AND STORAGE MEDIUM

BACKGROUND

1. Field

Aspects of the present invention generally relate to an image forming apparatus, a control method, and a storage medium.

2. Description of the Related Art

An image forming apparatus forms an image on a sheet by using a recording material such as toner. Generally, a recording material is stored in a storage unit such as a cartridge. Some of the image forming apparatuses are configured to detect an amount of the recording material remaining in the storage unit, and display the value thereof on a display unit such as a user interface (UI).

Conventionally, a sensor is provided in the image forming apparatus, and a value detected by the sensor is displayed as a remaining amount of the recording material as it is. As the sensor, taking cost into consideration, such a sensor that exhibits high detection accuracy only when the remaining amount of the recording material decreases considerably to a certain level is often used. In this case, the sensor detects the remaining amount of the recording material in discrete values such as 100%, 20%, 0%. As a result, the display unit also displays the remaining amount of the recording material in discrete values such as 100%, 20%, 0%.

On the other hand, there is another technique of displaying a remaining amount of a recording material in continuous values on a display unit, while using a sensor that discretely detects the remaining amount of the recording material (see Japanese Patent Application Laid-Open No. 2006-343621). For example, when image formation is performed, a predictive value of a remaining toner amount is calculated based on a dot count value of raster data, and the value is displayed as a current value of the remaining toner amount. Then, when a sensor value of the remaining toner amount is obtained from the sensor, the current value is updated with the sensor value.

When a toner cartridge is replaced, it is necessary to initialize the current value of the remaining toner amount. For this purpose, a remaining toner amount value stored in a memory tag of a toner cartridge is used as the initial value of the remaining toner amount. Then, in a case where any remaining toner amount value is not stored, the initial value of the remaining toner amount is calculated based on the number of printed pages or the like stored in the memory tag of the toner cartridge.

However, when the initial value of the remaining toner amount is calculated based on the number of printed pages or the like, if the calculation value contains an error, the current value of the remaining toner amount cannot be appropriately initialized. This makes it impossible to appropriately display the remaining toner amount, at least until the sensor detects the remaining toner amount. This problem is particularly serious in a case where the remaining toner amount is small in a cartridge after replacement. For example, assume a case where the calculated value is smaller than the predetermined value, though the real remaining toner amount is actually not smaller than the predetermined value (for example, a "low" level (20%), an "out" level (0%), etc.). In this case, if the calculated value is used as the initial value of the remaining toner amount, warning is issued at timing when the warning should not be issued, which makes a user confused. Further, for example, assume a case where the calculated value is greater than the predetermined value, though the remaining toner amount is actually smaller than the predetermined value (for example "low" level (20%), "out" level (0%)). In this case, if the calculated value is used as the initial value of the remaining toner amount, warning is not issued at timing when it should be issued, which causes inconvenience to a user.

SUMMARY

Aspects of the present invention are generally directed to an image forming apparatus and a control method capable of appropriately initializing a current value of a remaining toner amount, even if an initial value of a remaining toner amount is calculated based on the number of printed pages and the calculated value contains an error.

According to an aspect of the present invention, an image forming apparatus configured to form an image using a recording material stored in a storage unit includes an acquisition unit configured to acquire first information for calculating a remaining amount of the recording material in the storage unit and second information indicating that the remaining amount of the recording material in the storage unit is less than a predetermined value when the storage unit is mounted in the image forming apparatus, a calculation unit configured to calculate the remaining amount of the recording material in the storage unit based on the first information, and a setting unit configured to, in a case where the value calculated by the calculation unit is less than the predetermined value and the acquisition unit has not acquired the second information, set the predetermined value or a value a predetermined amount greater than the predetermined value as an initial value of the remaining amount of the recording material in the storage unit.

Further features of the present disclosure will become apparent from the following description of exemplary embodiments with reference to the attached drawings.

BRIEF DESCRIPTION OF THE DRAWINGS

FIG. 11 is a table illustrating an outline of initialization of a current value of a remaining toner amount.

DESCRIPTION OF THE EMBODIMENTS

Figure 1:
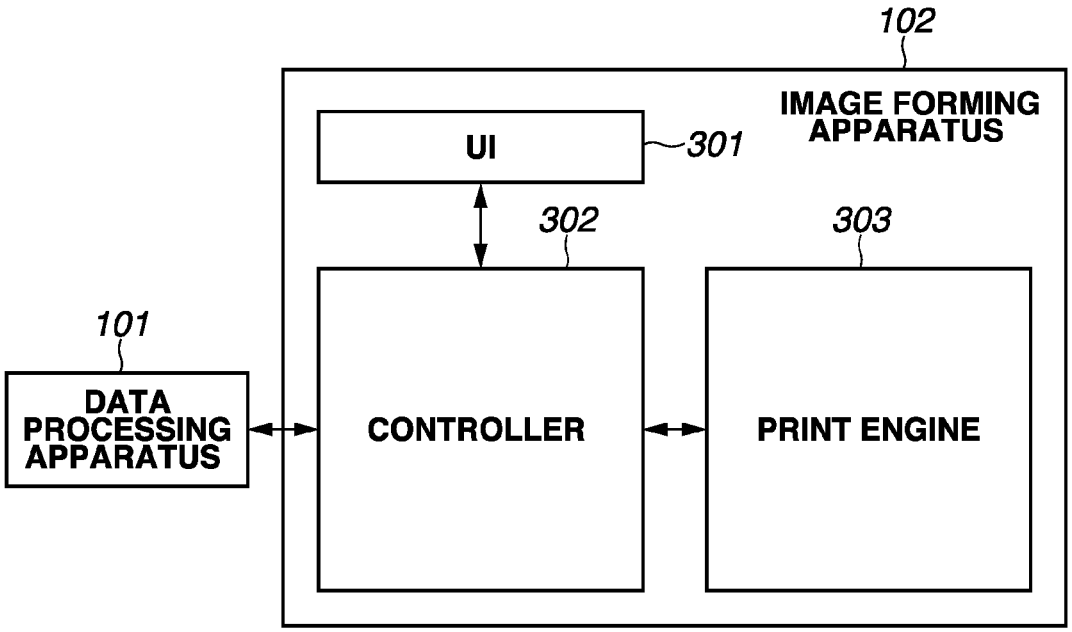
FIG. 1 is a block diagram illustrating a configuration of an image forming apparatus.

FIG. 1 is a block diagram illustrating a configuration of an image forming apparatus according to an exemplary embodiment.

A data processing apparatus 101 (for example, a personal computer (PC)) generates image data, and transmits the generated image data to an image forming apparatus 102.

The image forming apparatus 102 (for example, a laser printer) receives image data from the data processing apparatus 101, and forms an image on a sheet based on the image data. The image forming apparatus 102 may be a multi-function peripheral (MFP) having a scanner function, a FAX function, and the like.

A user interface (UI) 301 includes a display unit that provides a variety of information to a user, and an operation unit that receives a variety of operations from a user. On the display unit, a current value of a remaining toner amount is displayed, which is to be described below. A current value of a remaining toner amount may be transmitted to an external device such as the data processing apparatus 101 via an external interface (I/F), and may be displayed on a display unit provided in an external device such as the data processing apparatus 101.

A controller 302 generates bit map data based on print description language (PDL) data, and transmits the generated bit map data to a print engine 303. Details of the controller 302 are to be described below with reference to FIG. 2.

The print engine 303 forms an image on a sheet based on the bit map data received from the controller 302 with toner by using the electrophotographic method. The image formation method may be, for example, an ink-jet method, other than the electrophotographic method. In this case, the recording material used in the electrophotographic method is toner, and the recording material used in the ink-jet method is ink.

In the present exemplary embodiment, the controller 302 and the print engine 303 are separately configured, but may be configured integrally.

Figure 2:
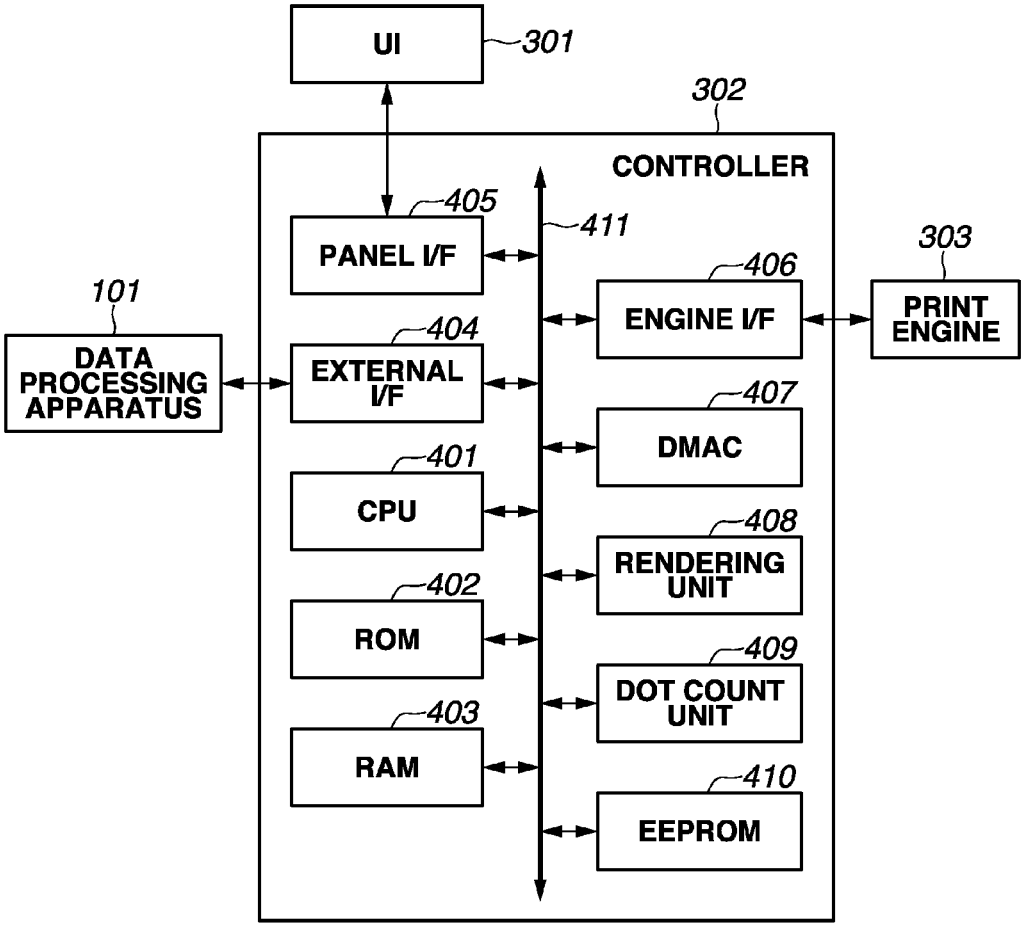
FIG. 2 is a block diagram illustrating a configuration of a controller.

FIG. 2 is a block diagram illustrating a configuration of a controller 302.

A central processing unit (CPU) 401 loads a program stored in a read-only memory (ROM) 402, in a random access memory (RAM) 403, and executes the program so as to control the image forming apparatus 102. Further, the CPU 401, as described below, calculates a remaining toner amount based on a predictive value of a toner consumed amount that is converted from a dot count counted by a dot count unit 409, and a sensor value of a remaining toner amount notified from the print engine 303. Then, the CPU 401 displays the calculated remaining toner amount on the UI 301 via a panel I/F 405, or notifies the data processing apparatus 101 of the calculated remaining toner amount via an external I/F 404.

The ROM 402 stores a program to be executed by the CPU 401, and the like.

The RAM 403 stores a program loaded from the ROM 402, and the like. Further, the RAM 403 also stores PDL data, intermediate data generated by interpreting the PDL data, bit map data generated by rendering intermediate data, and various types of temporary processing statuses, log information, etc., which are necessary for other processing.

The external I/F 404 mutually connects the data processing apparatus 101 and the controller 302, and relays data communication therebetween, that is, data transmission and reception.

The panel I/F 405 mutually connects the UI 301 and the controller 302, and relays data communication therebetween, that is, data transmission and reception.

An engine I/F 406 mutually connects the print engine 303 and the controller 302, and relays data communication therebetween, that is, data transmission and reception.

A direct memory access controller (DMAC) 407 receives an instruction from the CPU 401, and performs data access, that is, data writing and reading to and from the RAM 403.

A rendering unit 408 rasterizes intermediate data into bit map data.

The dot count unit 409 counts the number of dots that consume toner when image formation is performed, among dots contained in the rasterized bit map data. More specifically, the number of dots of colors other than white is counted. For example, in a case of monochrome printing, the number of dots corresponding to black (K) is counted. Further, in a case of color printing, the number of dots corresponding to any of yellow (Y), magenta (M), cyan (C), and black (K) is counted. The number of dots may be counted by the CPU 401 or the rendering unit 408.

An electrically erasable programmable read-only memory (EEPROM) 410 stores setting information and the like of the image forming apparatus 102.

A bus 411 mutually connects the constituent elements in the controller 302.

Figure 3:
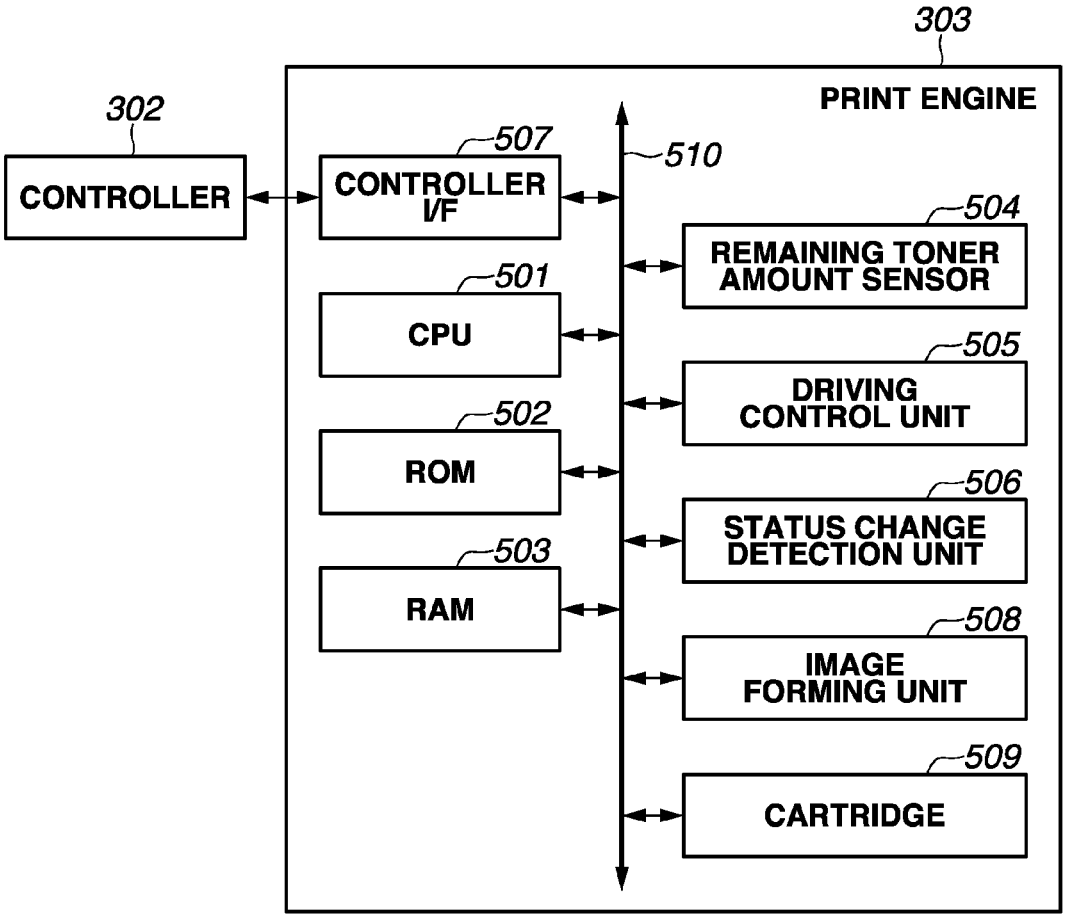
FIG. 3 is a block diagram illustrating a configuration of a print engine.

FIG. 3 is a block diagram illustrating a configuration of a print engine.

A CPU 501 loads a program stored in a ROM 502, into a RAM 503, and executes the program, so as to control the print engine 303.

The ROM 502 stores the program and the like to be executed by the CPU 501.

The RAM 503 stores the program and the like loaded from the ROM 502.

A remaining toner amount sensor 504 measures a remaining toner amount stored in a cartridge 509. Examples of the method for detecting a remaining toner amount used by a sensor include a magnetic permeability detection method, a magnetostrictive method, a piezoelectric oscillation method, and a transmitted light method. When the remaining toner amount reaches a predetermined value such as 20%, 0%, etc., the sensor detects the value as a sensor value. In other words, when the remaining toner amount is in a range of 100% to 21%, the sensor value is detected as 100%, when the remaining toner amount is in a range of 20% to 1%, the sensor value is detected as 20%, and when the remaining toner amount is 0%, the sensor value is detected as 0%. The sensor may be provided in the cartridge 509.

A driving control unit 505 drives various types of motors that are necessary when an image forming unit 508 forms images.

A status change detection unit 506 detects a status change such as jamming and cover-opening in the image forming apparatus. Further, the status change detection unit 506 detects replacement of the cartridge 509. A status change may be detected by the CPU 501.

A controller I/F 507 mutually connects the controller 302 and the print engine 303, and relays data communication therebetween, that is, data transmission and reception.

The image forming unit 508 forms an image on a sheet by the electrophotographic method using toner, based on the bit map data received from the controller 302.

The cartridge 509 is a so-called process cartridge installable in the image forming apparatus 102, as a storage unit that stores toner, and stores toner or the like that is used when the image forming unit 508 forms images. Further, the cartridge 509 has a non-volatile storage medium, in which cartridge information is stored. The cartridge information contains, for example, information indicating whether the cartridge is new, color information indicating the color of the cartridge, and remaining toner amount information indicating a current remaining toner amount in the cartridge. The cartridge 509 is connected to the bus 510, but it may be connected to the CPU 501 via an exclusive line.

The bus 510 mutually connects constituent elements in the print engine 303.

Figure 4:
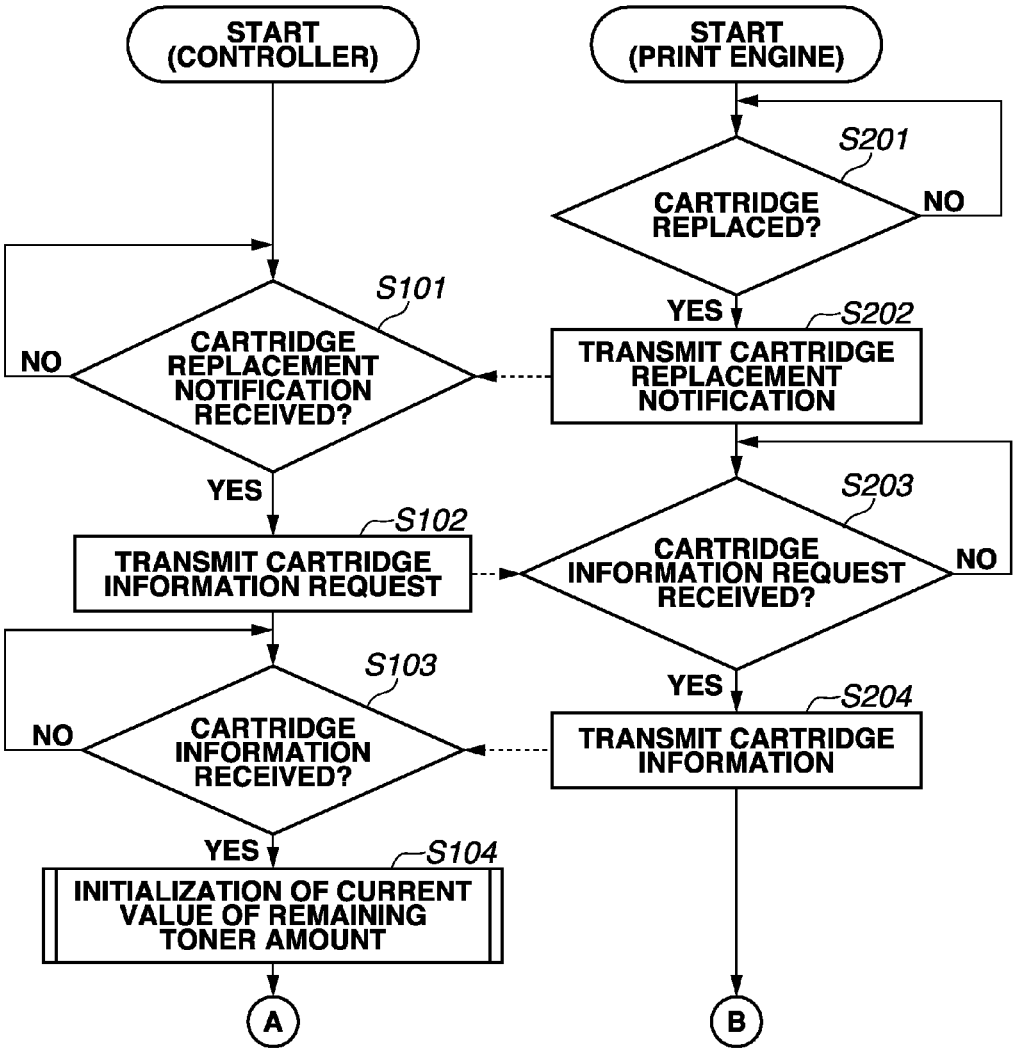
FIG. 4 is a flowchart (first half) illustrating control of remaining toner amount detection.
Figure 5:
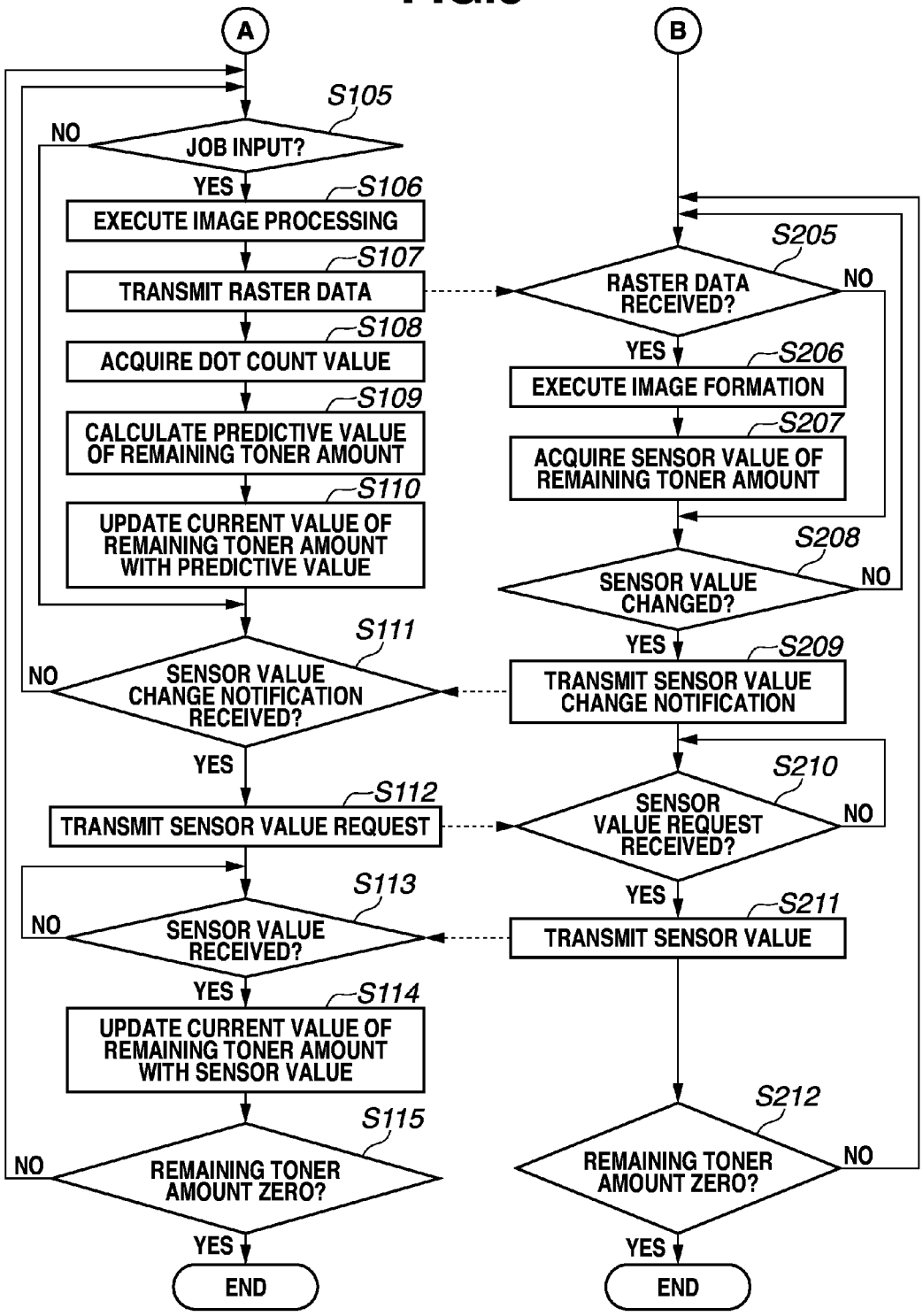
FIG. 5 is a flowchart (latter half) illustrating control of remaining toner amount detection.

FIGS. 4 and 5 are flowcharts illustrating the control of remaining toner amount detection.

The control illustrated in the flowchart on the left side (i.e., the flowchart performed in the controller 302) is realized as follows: the CPU 401 loads a control program stored in the ROM 402, into the RAM 403, and executes the control program. Further, the control illustrated in the flowchart on the right side (i.e., the flowchart performed in the print engine 303) is realized as follows: the CPU 501 loads a control program stored in the ROM 502, into the RAM 503, and executes the same.

First, in step S201, the CPU 501 determines whether the cartridge 509 is replaced. This is determined by detecting whether a new cartridge 509 is mounted in the image forming apparatus 102. The mounting of the cartridge 509 can be recognized when the status change detection unit 506 detects the mounting of the cartridge 509 and notifies the detection to the CPU 501. The mounting of the cartridge 509 may be detected according to the opening/closing of a cover provided for the replacement of the cartridge 509, or with use of a button or a switch whose ON/OFF state is changed by hardware according to the attachment/detachment of a component. If the CPU 501 determines that the cartridge 509 is replaced (YES in step S201), the processing proceeds to step S202. If the CPU 501 determines that the cartridge 509 is not replaced (NO in step S201), the CPU 501 enters a standby state.

Next, in step S202, the CPU 501 transmits a cartridge replacement notification indicating that the cartridge 509 is replaced, via the controller I/F 507 to the controller 302.

Next, in step S101, the CPU 401 determines whether the cartridge replacement notification is received via the engine I/F 406 from the print engine 303. If the CPU 401 determines that the cartridge replacement notification is received (YES in step S101), the processing proceeds to step S102. If the CPU 401 determines that the cartridge replacement notification is not received (NO in step S101), the CPU 401 enters a standby state.

Next, in step S102, the CPU 401 transmits a cartridge information request for requesting cartridge information about the cartridge 509, via the engine I/F 406 to the print engine 303.

Next, in step S203, the CPU 501 determines whether the cartridge information request is received via the controller I/F 507 form the controller 302. If the CPU 501 determines that the cartridge information request is received (YES in step S203), the processing proceeds to step S204. If the CPU 501 determines that the cartridge information request is not received (NO in step S203), the CPU 501 enters a standby state.

Next, in step S204, the CPU 501 transmits cartridge information about the cartridge 509 via the controller I/F 507 to the controller 302.

Next, in step S103, the CPU 401 determines whether the cartridge information is received via the engine I/F 406 from the print engine 303. If the CPU 401 determines that the cartridge information is received (YES in step S103), the processing proceeds to step S104. If the CPU 401 determines that the cartridge information is not received (NO in step S103), the CPU 401 enters a standby state.

Next, in step S104, the CPU 401 initializes a current value of a remaining toner amount based on the cartridge information. In the present exemplary embodiment, the current value of the remaining toner amount refers to a value that is recognized by the controller 302 as a remaining toner amount of the cartridge 509, which is displayed via the UI 301 to a user. The current value of the remaining toner amount is held in the RAM 403 or the like. Details of the step S104 are to be described below with reference to FIG. 7.

Next, in step S105, the CPU 401 determines whether a job of which image formation is to be executed is input via the external I/F 404 from the data processing apparatus 101. Here, examples of the job include a PDL printing job, a copy job, and a facsimile receiving/printing job. If the CPU 401 determines that the job is input (YES in step S105), the processing proceeds to step S106. If the CPU 401 determines that the job is not input (NO in step S105), the processing proceeds to step S111.

Next, in step S106, the CPU 401 executes image processing required for image formation, based on the job. The image processing includes processing of controlling the rendering unit 408 and rasterizing print data, thereby generating raster data.

Next, in step S107, the CPU 401 transmits the raster data generated through the image processing, via the engine I/F 406 to the print engine 303.

Next, in step S108, from the dot count unit 409, the CPU 401 obtains a dot count value that is determined when the raster data is generated. In this case, the dot count value may be obtained per page, or per job.

Next, in step S109, the CPU 401 calculates a predictive value of the remaining toner amount based on the dot count value obtained in step S108. More specifically, first, the following calculation is carried out: (dot count value [dot] at execution of printing of a current job or page)×(toner consumption amount per dot [g/dot])=(toner consumption amount [g] at execution of current job). In the above-described equation, the toner consumption amount per dot may be preliminarily stored in the ROM 402, or may be contained in the cartridge information received in step S103. Next, the following calculation is carried out: (current remaining toner amount [g])−(toner consumption amount [g] at current job execution)=(new remaining toner amount [g]). Next, the following calculation is carried out: (new remaining toner amount [g])/(remaining toner amount [g] in cartridge in unused state)=(new predictive value [%] of remaining toner amount). In the above-described equation, the remaining toner amount in cartridge in unused state may be preliminarily stored in the ROM 402, or may be contained in the cartridge information received in step S103.

Next, in step S110, the CPU 401 updates the current value of the remaining toner amount, using the predictive value calculated in step S109.

On the other hand, in step S205, the CPU 501 determines whether the raster data is received via the controller I/F 507 from the controller 302. If the CPU 501 determines that the raster data has been received (YES in step S205), the processing proceeds to step S206. If the CPU 501 determines that the raster data has not been received (NO in step S205), the processing proceeds to step S208.

Next, in step S206, the CPU 501 forms an image based on the raster data, by controlling the image forming unit 508.

Next, in step S207, the CPU 501 obtains a sensor value of the remaining toner amount from the remaining toner amount sensor 504. The timing of obtaining the sensor value may be the timing when the image formation per page is completed, or may be the timing when image formation per job is completed. Further, the timing of obtaining the sensor value may be every time when a predetermined time elapses.

Next, in step S208, the CPU 501 determines whether the sensor value obtained this time has changed from the sensor value obtained previous time. If the CPU 501 determines that the sensor value obtained this time has changed (YES in step S208), the processing proceeds to step S209. If the CPU 501 determines that the sensor value obtained this time has not changed (NO in step S208), the processing returns to step S205.

Next, in step S209, the CPU 501 transmits a sensor value change notification indicating that the sensor value has changed, via the controller I/F 507 to the controller 302.

Next, in step S111, the CPU 401 determines whether the sensor value change notification is received via the engine I/F 406 from the print engine 303. If the CPU 401 determines that the sensor value change notification has been received (YES in step S111), the processing proceeds to step S112. If the CPU 401 determines that the sensor value change notification has not been received (NO in step S111), the processing returns to step S105.

Next, in step S112, the CPU 401 transmits a sensor value request for requesting a sensor value via the engine I/F 406 to the print engine 303.

Next, in step S210, the CPU 501 determines whether the sensor value request is received via the controller I/F 507 from the controller 302. If the CPU 501 determines that the sensor value request has been received (YES in step S210), the processing proceeds to step S211. If the CPU 501 determines that the sensor value request has not been received (NO in step S210), the CPU 501 enters a standby state.

Next, in step S211, the CPU 501 transmits a sensor value via the controller I/F 507 to the controller 302.

Next, in step S113, the CPU 401 determines whether the sensor value is received via the engine I/F 406 from the print engine 303. If the CPU 401 determines that the sensor value has been received (YES in step S113), the processing proceeds to step S114. If the CPU 401 determines that the sensor value has not been received (NO in step S113), the CPU 401 enters a standby state.

Next, in step S114, the CPU 401 updates the current value of the remaining toner amount, using the sensor value received in step S113.

Next, in step S115, the CPU 401 determines whether the remaining toner amount has become zero, referring to the current value of the remaining toner amount. If the CPU 401 determines that the remaining toner amount has become zero (YES in step S115), the CPU 401 ends the processing. If the CPU 401 determines that the remaining toner amount has not become zero (NO in step S115, the processing returns to step S105.

On the other hand, in step S212, the CPU 501 determines whether the remaining toner amount has become zero, referring to the sensor value of the remaining toner amount. If the CPU 501 determines that the remaining toner amount has become zero (YES in step S212), the CPU 501 ends the processing. If the CPU 501 determines that the remaining toner amount has not become zero (NO in step S212), the processing returns to step S205.

Figure 6:
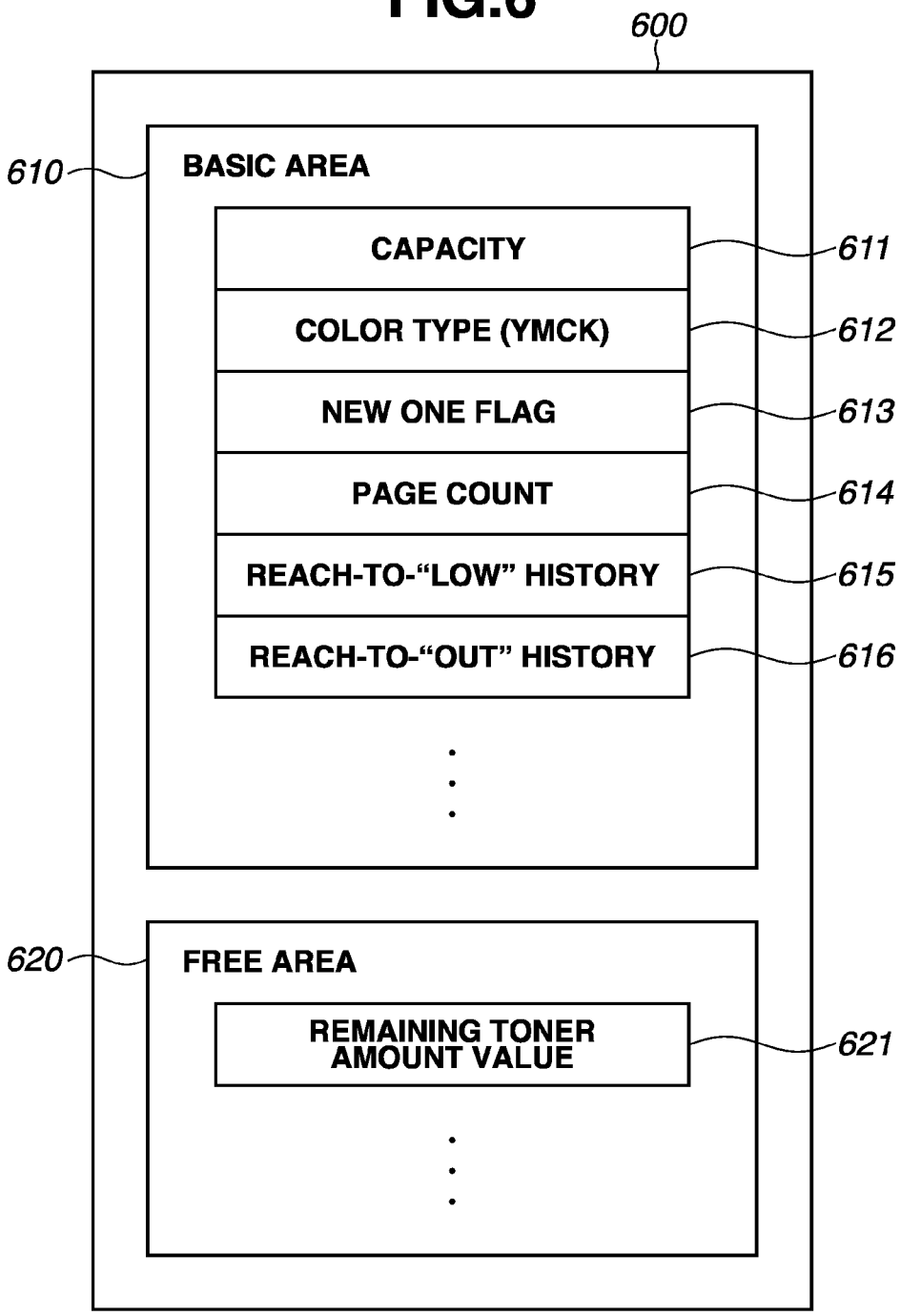
FIG. 6 illustrates a data configuration of a memory tag.

FIG. 6 illustrates a data configuration of a memory tag. The memory tag refers to a non-volatile storage medium incorporated in the cartridge 509.

An entire data area 600 includes a basic area 610, and a free area 620.

The basic area 610 includes a capacity 611, a color type (YMCK) 612, a new one flag 613, a page count 614, a reach-to-"low" history 615, and a reach-to-"out" history 616. They are referred to as cartridge information.

The capacity 611 indicates a capacity of the cartridge 509 for storing toner.

The color type (YMCK) 612 indicates a color of toner stored in the cartridge 509.

The new one flag 613 indicates whether the toner cartridge is new.

The page count 614 indicates the number of pages printed using the cartridge 509.

The reach-to-"low" history 615 indicates whether the remaining toner amount of the cartridge 509 reaches the "low" level (20%). The "low" level is a value indicating that the remaining amount of the recording material is small, but this value may be set to a value other than 20% (for example, 10%, or 15%).

The reach-to-"out" history 616 indicates whether the remaining toner amount of the cartridge 509 reaches an "out" level (0%). The "out" level described above refers to a value that indicates the remaining amount of the recording material becomes zero, but this value may be set to a value other than 0% (for example, 1 to 3%).

The free area 620 includes a remaining toner amount value 621. To the free area 620, new information can be arbitrarily added and changed, in response to a request from the CPU 501.

The remaining toner amount value 621 indicates a remaining toner amount [%] of the cartridge 509. The remaining toner amount indicated by weight [g] may be stored.

Figure 7:
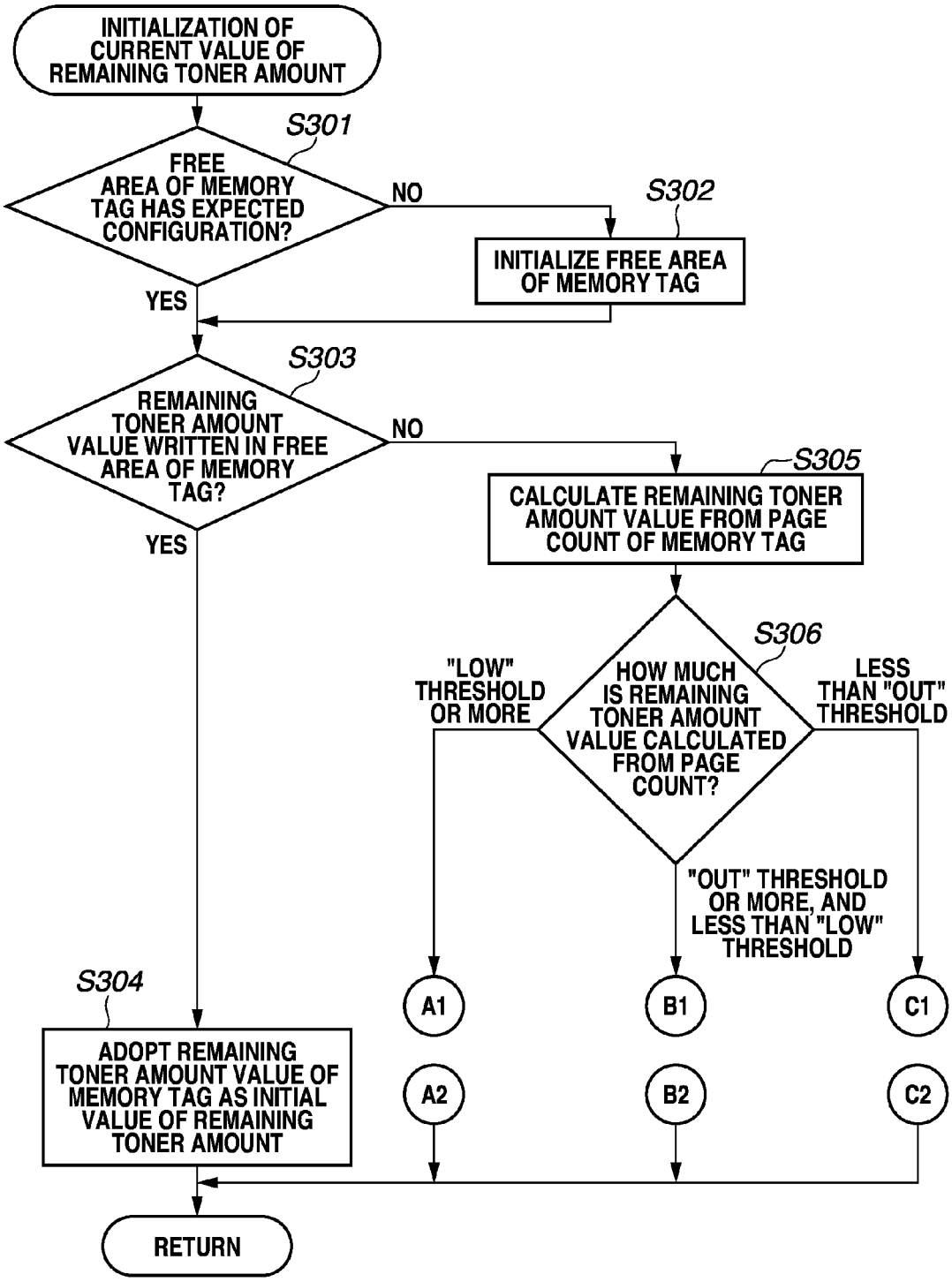
FIG. 7 is an entire flowchart illustrating details of initialization of a current value of a remaining toner amount.

FIG. 7 is an entire flowchart illustrating details of initialization of a current value of a remaining toner amount.

In execution of the processing illustrated in FIG. 7, various types of information of the memory tag contained in the cartridge information received in step S103 (described above with reference to FIG. 6) are used.

First, in step S301, the CPU 401 determines whether the free area 620 of the memory tag has an expected configuration. The expected configuration refers to a state in which a particular part configured not to be written according to the program for the controller 302, in the free area 620, has a value at the time of shipping. The controller 302 is programmed so as to store information in a different format depending on the type of the model, in the free area 620. Therefore, for example, the remaining toner amount value 621, and unused areas other than the other information areas should have values at the time of shipping. However, in a case where information is written in the free area 620 not according to the format, or a case where information is rewritten by a certain cause, the controller 302 can detect that the remaining toner amount value 621, and unused areas other than the other information areas have values other than the values at the time of shipping. This state in which the values are other than the values at the time of shipping means a state of "not having the expected configuration". If the CPU 401 determines that the free area 620 of the memory tag has an expected configuration (YES in step S301), the processing proceeds to step S303. If the CPU 401 determines that the free area 620 of the memory tag has not an expected configuration (NO in step S301), the processing proceeds to step S302.

Next, in step S302, the CPU 401 initializes the free area 620 of the memory tag. At that time, the CPU 401 transmits a write command to write an initial value for initialization into the memory tag, to the print engine 303. The print engine 303 initializes the free area 620 of the memory tag according to the write command. Here, the initialization of the free area 620 refers to an operation of returning the values of the remaining toner amount value 621 and areas other than the other information areas, which are not used originally, to values at the time of shipping, according to a format of a target device type.

Next, in step S303, the CPU 401 determines whether the remaining toner amount value 621 is written in the free area 620 of the memory tag. In other words, the CPU 401 determines whether values other than the values at the time of shipping are written. If the CPU 401 determines that the remaining toner amount value 621 is written (YES in step S303), the processing proceeds to step S304. If the CPU 401 determines that the remaining toner amount value 621 is not written (NO in step S303), the processing proceeds to step S305.

Next, in step S304, the CPU 401 adopts the remaining toner amount value 621 written in the free area 620 of the memory tag, as the remaining toner amount initial value (sets the value as the current value of the remaining toner amount).

Next, in step S305, the CPU 401 calculates the remaining toner amount value based on the value of the page count 614 in the basic area 610 of the memory tag. More specifically, the CPU 401 multiplies the value of the page count by a toner consumption amount per page (g/page) under predetermined conditions, thereby calculating the toner consumption amount (g). Then, the CPU 401 subtracts the toner consumption amount (g) from the capacity (g) of the toner cartridge, thereby calculating the remaining toner amount (g). Then, the CPU 401 divides the remaining toner amount (g) by the capacity (g) of the toner cartridge, thereby determining the remaining toner amount value (%).

Next, in step S306, the CPU 401 determines in which range the remaining toner amount value calculated in step S305 falls: a toner "low" threshold value (20%) or more; a toner "out" threshold value (0%) or more, and less than the toner "low" threshold value (20%); or less than the toner "out" threshold value (0%). In step S306, in the case where the remaining toner amount value is equal to the toner "low" threshold value (20%) or more, then, the processing proceeds to A1 (described below with reference to FIG. 8). In step S306, in the case where the remaining toner amount value is equal to the toner "out" threshold value (0%) or more, and less than the toner "low" threshold value (20%), then, the processing proceeds to B1 (described below with reference to FIG. 9). In step S306, in the case where the remaining toner amount value is less than the toner "out" threshold value (0%), then, the processing proceeds to C1 (described below with reference to FIG. 10).

Figure 8:
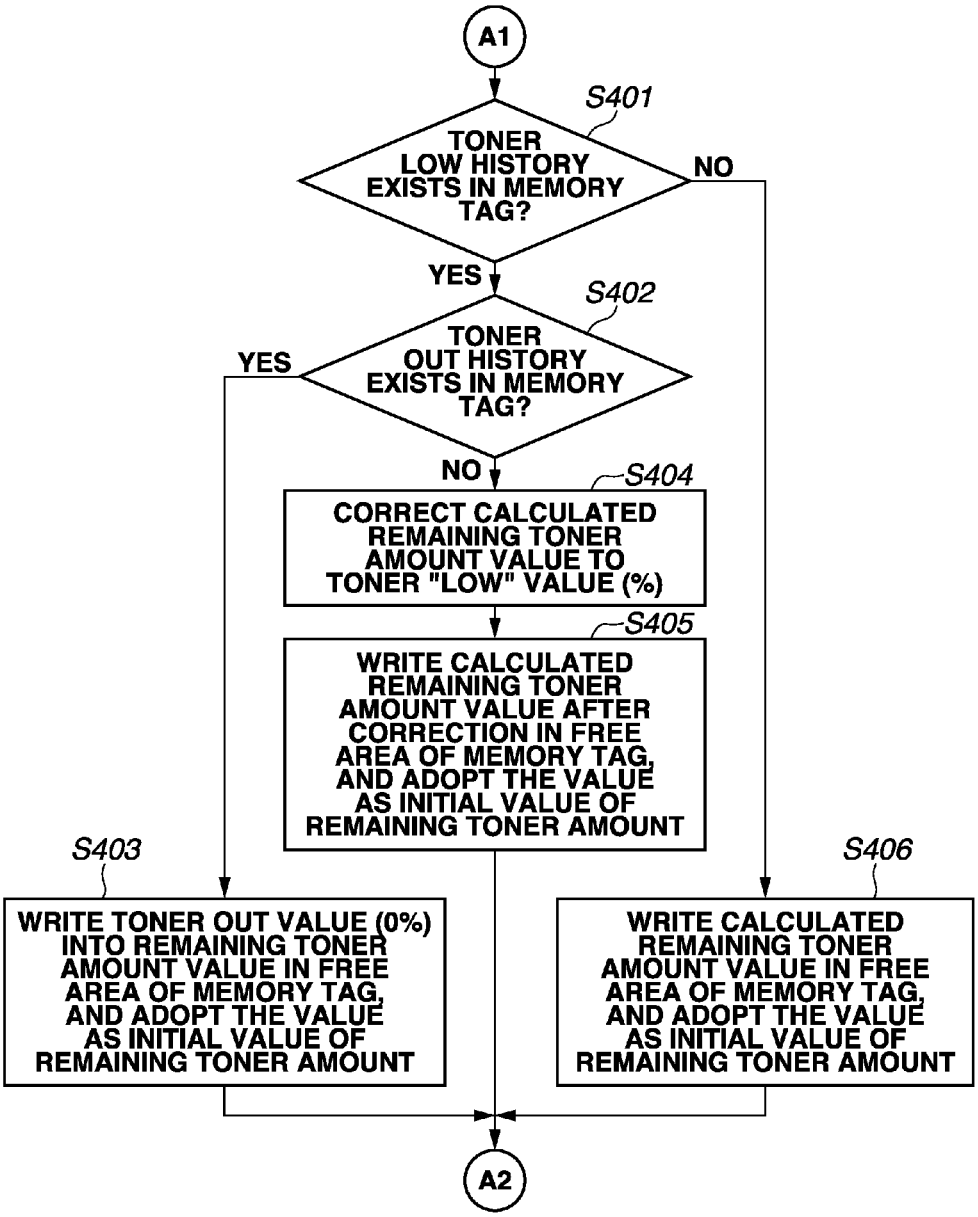
FIG. 8 is a flowchart (A1 to A2) illustrating details of initialization of a current value of a remaining toner amount.

FIG. 8 is a flowchart (A1 to A2) illustrating details of initialization of a current value of a remaining toner amount.

First, in step S401, the CPU 401 determines whether the reach-to-"low" history 615 exists in the memory tag. If the CPU 401 determines that the reach-to-"low" history 615 exists in the memory tag (YES in step S401), the processing proceeds to S402. If the CPU 401 determines that the reach-to-"low" history 615 does not exist in the memory tag (NO in step S401), the processing proceeds to S406.

Next, in step S402, the CPU 401 determines whether the reach-to-"out" history 616 exists in the memory tag. If the CPU 401 determines that the reach-to-"out" history 616 exists in the memory tag (YES in step S402), the processing proceeds to S403. If the CPU 401 determines that the reach-to-"out" history 616 does not exist in the memory tag (NO in step S402), the processing proceeds to S404.

Next, in step S403, the CPU 401 writes the toner out value (0%) into the remaining toner amount value 621 of the memory tag, and adopts the value as the remaining toner amount initial value (sets the value as the current value of the remaining toner amount).

Next, in step S404, the CPU 401 corrects the remaining toner amount value calculated in step S305, to the toner "low" threshold value (20%).

Next, in step S405, the CPU 401 writes the remaining toner amount value corrected in step S404 into the remaining toner amount value 621 of the memory tag, and adopts the value as the remaining toner amount initial value (set the value as the current value of the remaining toner amount).

Next, in step S406, the CPU 401 writes the remaining toner amount value calculated in step S305 into the remaining toner amount value 621 of the memory tag, and adopts the value as the remaining toner amount initial value (set the value as the current value of the remaining toner amount).

Figure 9:
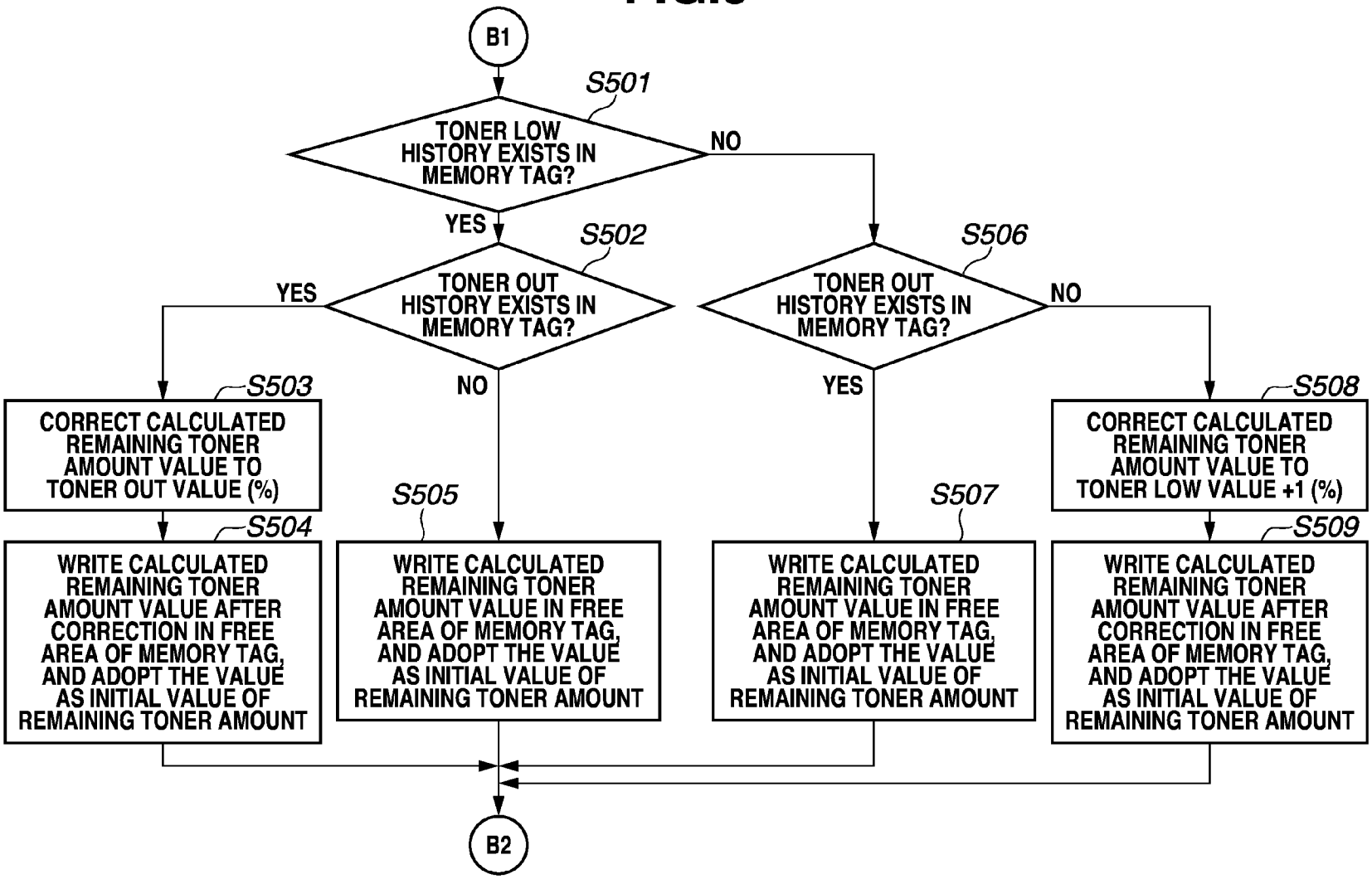
FIG. 9 is a flowchart (B1 to B2) illustrating details of initialization of a current value of a remaining toner amount.

FIG. 9 is a flowchart (B1 to B2) illustrating details of initialization of a current value of a remaining toner amount.

First, in step S501, the CPU 401 determines whether the reach-to-"low" history 615 exists in the memory tag. If the CPU 401 determines that the reach-to-"low" history 615 exists in the memory tag (YES in step S501), the processing proceeds to S502. If the CPU 401 determines that the reach-to-"low" history 615 does not exist in the memory tag (NO in step S501), the processing proceeds to step S506.

Next, in step S502, the CPU 401 determines whether the Reach-to-"out" history 616 exists in the memory tag. If the CPU 401 determines that the Reach-to-"out" history 616 exists in the memory tag (YES in step S502), the processing proceeds to S503. If the CPU 401 determines that the Reach-to-"out" history 616 does not exist in the memory tag (NO in step S502), the processing proceeds to step S505.

Next, in step S503, the CPU 401 corrects the remaining toner amount value calculated in step S305 to the toner "out" threshold value (0%).

Next, in step S504, the CPU 401 writes the remaining toner amount value thus corrected in step S503 into the remaining toner amount value 621 of the memory tag, and adopts the value as the remaining toner amount initial value (set the value as the current value of the remaining toner amount).

Next, in step S505, the CPU 401 writes the remaining toner amount value calculated in step S305 into the remaining toner amount value 621 of the memory tag, and adopts the value as the remaining toner amount initial value (set the value as the current value of the remaining toner amount).

Next, in step S506, the CPU 401 determines whether the reach-to-"out" history 616 exists in the memory tag. If the CPU 401 determines that the reach-to-"out" history 616 exists in the memory tag (YES in step S506), the processing proceeds to step S507. If the CPU 401 determines that the reach-to-"out" history 616 does not exist in the memory tag (NO in step S506), the processing proceeds to S508.

Next, in step S507, the CPU 401 writes the remaining toner amount value calculated in step S305 into the remaining toner amount value 621 of the memory tag, and adopts the value as the remaining toner amount initial value (set the value as the current value of the remaining toner amount).

Next, in step S508, the CPU 401 corrects the remaining toner amount value calculated in step S305 to the toner "low" threshold value+1% (21%).

Next, in step S509, the CPU 401 writes the remaining toner amount value corrected in step S508 into the remaining toner amount value 621 of the memory tag, and adopts the value as the remaining toner amount initial value (set the value as the current value of the remaining toner amount).

Figure 10:
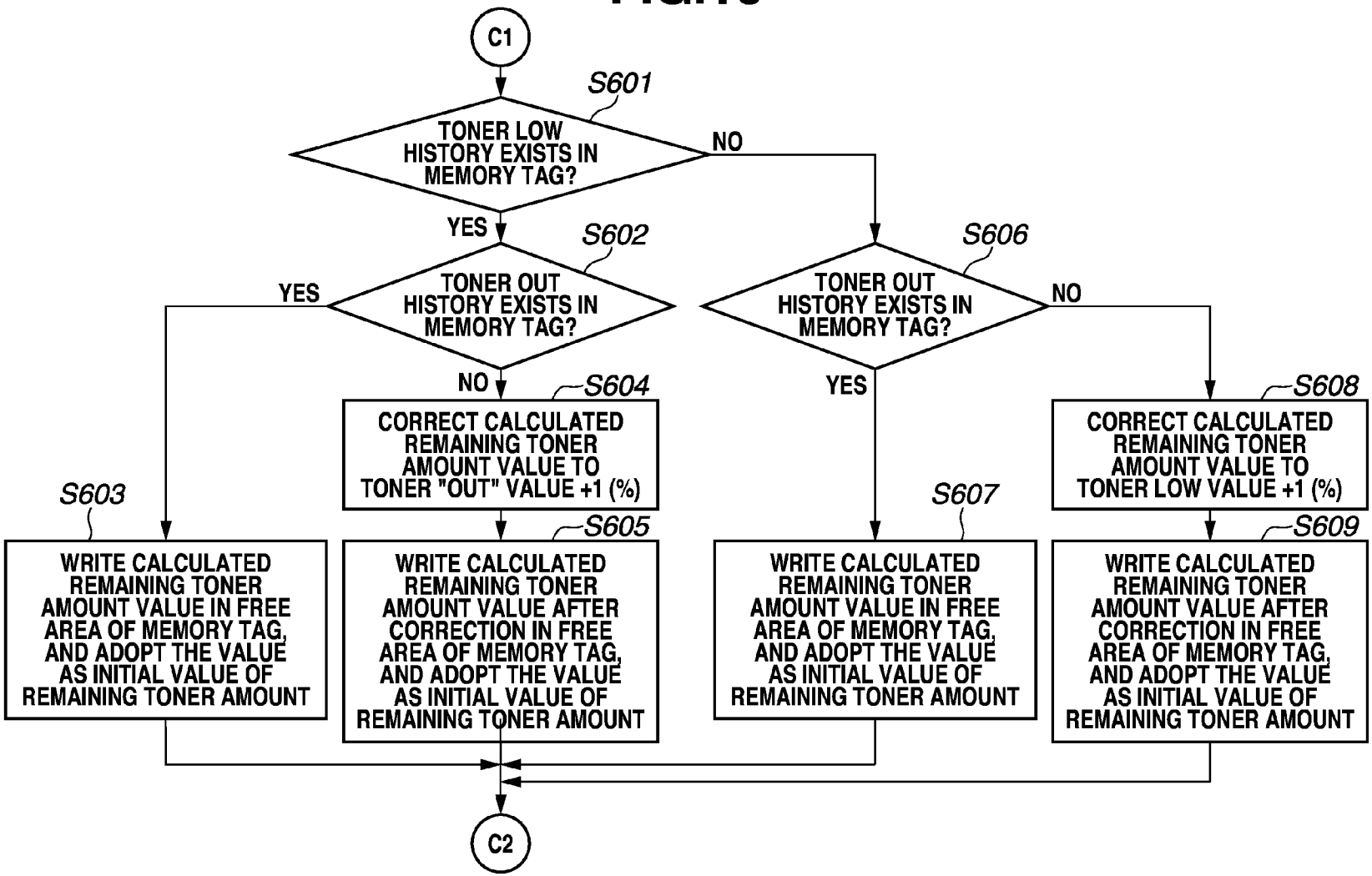
FIG. 10 is a flowchart (C1 to C2) illustrating details of initialization of a current value of a remaining toner amount.

FIG. 10 is a flowchart (C1 to C2) illustrating details of initialization of a current value of a remaining toner amount.

First, in step S601, the CPU 401 determines whether the reach-to-"low" history 615 exists in the memory tag. If the CPU 401 determines that the reach-to-"low" history 615 exists in the memory tag (YES in step S601), the processing proceeds to S602. If the CPU 401 determines that the reach-to-"low" history 615 does not exist in the memory tag (NO in step S601), the processing proceeds to S606.

Next, in step S602, the CPU 401 determines whether the reach-to-"out" history 616 exists in the memory tag. If the CPU 401 determines that the reach-to-"out" history 616 exists in the memory tag (YES in step S602), the processing proceeds to S603. If the CPU 401 determines that the reach-to-"out" history 616 does not exist in the memory tag (NO in step S602), the processing proceeds to step S604.

Next, in step S603, the CPU 401 writes the remaining toner amount value calculated in step S305 into the remaining toner amount value 621 of the memory tag, and adopts the value as the remaining toner amount initial value (set the value as the current value of the remaining toner amount).

Next, in step S604, the CPU 401 corrects the remaining toner amount value calculated in step S305 to the toner "out" threshold value+1% (1%).

Next, in step S605, the CPU 401 writes the remaining toner amount value corrected in step S604 into the remaining toner amount value 621 of the memory tag, and adopts the value as the remaining toner amount initial value (set the value as the current value of the remaining toner amount).

Next, in step S606, the CPU 401 determines whether the reach-to-"out" history 616 exists in the memory tag. If the CPU 401 determines that the reach-to-"out" history 616 exists in the memory tag (YES in step S606), the processing proceeds to S607. If the CPU 401 determines that the reach-to-"out" history 616 does not exist in the memory tag (NO in step S606), the processing proceeds to step S608.

Next, in step S607, the CPU 401 writes the remaining toner amount value calculated in step S305 into the remaining toner amount value 621 of the memory tag, and adopts the value as the remaining toner amount initial value (set the value as the current value of the remaining toner amount).

Next, in step S608, the CPU 401 corrects the remaining toner amount value calculated in step S305 to the toner "low" threshold value+1% (21%).

Next, in step S609, the CPU 401 writes the remaining toner amount value corrected in step S608 into the remaining toner amount value 621 of the memory tag, and adopts the value as the remaining toner amount initial value (set the value as the current value of the remaining toner amount).

FIG. 11 is a table illustrating an outline of initialization of the current value of the remaining toner amount. This is obtained by rearranging FIGS. 8 to 10 into a table.

In the present exemplary embodiment, whichever value is calculated from the page count value, a case where a Low history does not exist and an Out history exists never occurs basically. Therefore, in the present exemplary embodiment, in such a case, it is regarded as a fault, and a value calculated from the page count value is adopted without correction, but another predetermined value may be adopted (for example, 0%). Further, in such a case, the current value may be blinked or not-displayed, or a sound may be made, so as to warn a user.

Further, the values corrected in steps S404, S508, S604, and S608 may be the toner "low" value−1 (19%), the toner "low" threshold value (20%), the toner "out" threshold value (0%), and the toner "low" threshold value (20%), respectively. In other words, the predetermined value may be set to a value a predetermined amount greater than the predetermined value, or to a value a predetermined amount smaller than the predetermined value.

According to the present exemplary embodiment, even in such a situation that a previous remaining toner amount value cannot be obtained from a memory tag of a toner cartridge, an initial value of a remaining toner amount having less difference from a physical remaining amount thereof can be calculated, at least in the vicinities of no toner.

Other Embodiments

Additional embodiments can also be realized by a computer of a system or apparatus that reads out and executes computer executable instructions recorded on a storage medium (e.g., computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-179999 filed Aug. 30, 2013, which is hereby incorporated by reference herein in its entirety.

What is claimed is:

1. An image forming apparatus configured to form an image using a recording material stored in a storage unit, the image forming apparatus comprising:

an acquisition unit configured to, when the storage unit is mounted in the image forming apparatus, acquire first information for calculating a remaining amount of the recording material in the storage unit and second information indicating that the remaining amount of the recording material in the storage unit is less than a predetermined value;

a calculation unit configured to calculate the remaining amount of the recording material in the storage unit based on the first information; and a setting unit configured to, in a case where the value calculated by the calculation unit is less than the predetermined value and the acquisition unit has not acquired the second information, set the predetermined value or a value a predetermined amount greater than the predetermined value as an initial value of the remaining amount of the recording material in the storage unit.

2. The image forming apparatus according to claim 1, wherein the setting unit sets, in a case where the value calculated by the calculation unit is less than the predetermined value and the acquisition unit has acquired the second information, the value calculated by the calculation unit as the initial value of the remaining amount of the recording material in the storage unit.

3. The image forming apparatus according to claim 1, wherein the setting unit sets, in a case where the acquisition unit acquires third information indicating the remaining amount of the recording material in the storage unit, the value indicated by the third information as the initial value of the remaining amount of the recording material in the storage unit.

4. The image forming apparatus according to claim 1, wherein the predetermined value is a value indicating that the remaining amount of the recording material in the storage unit is small.

5. The image forming apparatus according to claim 1, wherein the predetermined value is a value indicating that the remaining amount of the recording material in the storage unit is zero.

6. The image forming apparatus according to claim 1, further comprising a display unit configured to display the remaining amount of the recording material set by the setting unit.

7. The image forming apparatus according to claim 1, further comprising a transmission unit configured to transmit the remaining amount of the recording material set by the setting unit.

8. The image forming apparatus according to claim 1, wherein the recording material is toner.

9. An image forming apparatus configured to form an image using a recording material stored in a storage unit, the image forming apparatus comprising:

an acquisition unit configured to, when the storage unit is mounted in the image forming apparatus, acquire first information for calculating a remaining amount of the recording material in the storage unit and second information indicating that the remaining amount of the recording material in the storage unit is less than a predetermined value;

a calculation unit configured to calculate the remaining amount of the recording material in the storage unit based on the first information; and a setting unit configured to, in a case where the value calculated by the calculation unit is greater than the predetermined value and the acquisition unit has acquired the second information, set the predetermined value or a value a predetermined amount less than the predetermined value as an initial value of the remaining amount of the recording material in the storage unit.

10. The image forming apparatus according to claim 9, wherein the setting unit sets, in a case where the value calculated by the calculation unit is greater than the predetermined value and the acquisition unit has not acquired the second information, the value calculated by the calculation unit as the initial value of the remaining amount of the recording material in the storage unit.

11. A method for controlling an image forming apparatus configured to form an image using a recording material stored in a storage unit, the method comprising:

acquiring, when the storage unit is mounted in the image forming apparatus, first information for calculating a remaining amount of the recording material in the storage unit and second information indicating that the remaining amount of the recording material in the storage unit is less than a predetermined value;

calculating the remaining amount of the recording material in the storage unit based on the first information; and setting, in a case where the calculated remaining amount is less than the predetermined value and the second information is not acquired, the predetermined value or a value a predetermined amount greater than the predetermined value, as an initial value of the remaining amount of the recording material in the storage unit.

12. A method for controlling an image forming apparatus configured to form an image using a recording material stored in a storage unit, the method comprising:

acquiring, when the storage unit is mounted in the image forming apparatus, first information for calculating a remaining amount of the recording material in the storage unit and second information indicating that the remaining amount of the recording material in the storage unit is less than a predetermined value;

calculating the remaining amount of the recording material in the storage unit based on the first information; and setting, in a case where the calculated remaining amount is greater than the predetermined value and the second information is acquired, the predetermined value or a value a predetermined amount less than the predetermined value as an initial value of the remaining amount of the recording material in the storage unit.

13. A computer readable storage medium storing computer executable instructions that cause an image forming apparatus configured to form an image using a recording material stored in a storage unit to execute a method, the method comprising:

acquiring, when the storage unit is mounted in the image forming apparatus, first information for calculating a remaining amount of the recording material in the storage unit and second information indicating that the remaining amount of the recording material in the storage unit is less than a predetermined value;

calculating the remaining amount of the recording material in the storage unit based on the first information; and setting, in a case where the calculated remaining amount is less than the predetermined value and the second information is not acquired, the predetermined value or a value a predetermined amount greater than the predetermined value as an initial value of the remaining amount of the recording material in the storage unit.

14. A computer readable storage medium storing computer executable instructions that cause an image forming device that forms an image using a recording material stored in a storage unit to execute a method, the method comprising:

acquiring, when the storage unit is mounted in the image forming apparatus, first information for calculating a remaining amount of the recording material in the storage unit and second information indicating that the remaining amount of the recording material in the storage unit is less than a predetermined value from the storage unit;

calculating the remaining amount of the recording material in the storage unit based on the first information; and setting, in a case where the calculated remaining amount is greater than the predetermined value and the second information is acquired, the predetermined value or a value a predetermined amount less than the predetermined value as an initial value of the remaining amount of the recording material in the storage unit.

* * * * *